US009022812B2

(12) United States Patent
Minich et al.

(10) Patent No.: US 9,022,812 B2
(45) Date of Patent: May 5, 2015

(54) ELECTRICAL CONNECTOR WITH REDUCED NORMAL FORCE

(71) Applicants: Steven E. Minich, York, PA (US); Mark R. Gray, York, PA (US)

(72) Inventors: Steven E. Minich, York, PA (US); Mark R. Gray, York, PA (US)

(73) Assignee: FCI Americas Technology LLC, Carson City, NV (US)

( * ) Notice: Subject to any disclaimer, the term of this patent is extended or adjusted under 35 U.S.C. 154(b) by 247 days.

(21) Appl. No.: 13/658,545

(22) Filed: Oct. 23, 2012

(65) Prior Publication Data

US 2013/0109246 A1 May 2, 2013

Related U.S. Application Data

(60) Provisional application No. 61/554,866, filed on Nov. 2, 2011.

(51) Int. Cl.
*H01R 13/10* (2006.01)
*H01R 4/48* (2006.01)

(52) U.S. Cl.
CPC ..... *H01R 4/48* (2013.01)

(58) Field of Classification Search
USPC ..... 439/626, 682, 889, 891
See application file for complete search history.

(56) References Cited

U.S. PATENT DOCUMENTS

| | | | | |
|---|---|---|---|---|
| 4,317,609 | A | 3/1982 | Lapraik | |
| 5,174,776 | A * | 12/1992 | Ohtaka et al. | 439/188 |
| 5,924,899 | A | 7/1999 | Paagman | |
| 6,142,790 | A * | 11/2000 | Niitsu | 439/66 |
| 6,309,262 | B1 | 10/2001 | Morris | |
| 6,672,886 | B2 | 1/2004 | Billman | |
| 7,331,800 | B2 | 2/2008 | Winings et al. | |
| 7,402,049 | B2 | 7/2008 | Polnyi | |
| 8,366,485 | B2 * | 2/2013 | Johnescu et al. | 439/607.07 |
| 2001/0044235 | A1 * | 11/2001 | Cohen | 439/625 |
| 2004/0072470 | A1 | 4/2004 | Lang et al. | |
| 2006/0019538 | A1 * | 1/2006 | Davis et al. | 439/608 |
| 2007/0205774 | A1 | 9/2007 | Minich | |
| 2008/0176453 | A1 * | 7/2008 | Minich et al. | 439/660 |
| 2008/0248658 | A1 * | 10/2008 | Cohen et al. | 439/55 |
| 2009/0130912 | A1 * | 5/2009 | Shuey et al. | 439/668 |
| 2010/0144201 | A1 * | 6/2010 | Defibaugh et al. | 439/607.05 |
| 2010/0240233 | A1 * | 9/2010 | Johnescu et al. | 439/108 |
| 2011/0097934 | A1 | 4/2011 | Minich | |
| 2011/0117781 | A1 | 5/2011 | Stoner | |
| 2011/0159744 | A1 | 6/2011 | Buck | |
| 2013/0109246 | A1 * | 5/2013 | Minich et al. | 439/682 |

FOREIGN PATENT DOCUMENTS

EP 0852414 7/1998

OTHER PUBLICATIONS

International Patent Application No. PCT/US2012/062084, International Search Report and Written Opinion, dated Mar. 8, 2013, 10 pages.

* cited by examiner

*Primary Examiner* — James Harvey
(74) *Attorney, Agent, or Firm* — Baker & Hostetler LLP

(57) ABSTRACT

An electrical connector system having electrical contacts with reduced normal force is provided. The electrical contacts can define cantilevered beams of extended length, such that normal forces exerted by the electrical contacts on the electrical contacts of a complementary electrical connector are reduced. The beams of the electrical contacts can be coupled by a tie bar that can act to enhance the structural rigidity of the electrical contact.

21 Claims, 10 Drawing Sheets

ELECTRICAL CONNECTOR WITH REDUCED NORMAL FORCE

CROSS-REFERENCE TO RELATED APPLICATIONS

This application claims the benefit of U.S. Provisional Application No. 61/554,866 filed Nov. 2, 2011, the contents of which is hereby incorporated by reference herein in its entirety.

BACKGROUND

Electrical connectors provide signal connections between electronic devices using electrically-conductive contacts, or electrical contacts. In some applications, an electrical connector provides a connectable interface between one or more substrates, e.g., printed circuit boards. Such an electrical connector may include a receptacle connector mounted to a first substrate and a complementary header connector mounted to a second substrate. Typically, a first plurality of electrical receptacle contacts in the receptacle connector is adapted to mate with a corresponding plurality of electrical header contacts in the header connector. For instance, the electrical receptacle contacts can receive the electrical header contacts so as to establish an electrical connection between the electrical receptacle contacts and the electrical header contacts.

When complementary electrical connectors are mated, for instance a header connector mated to a complementary receptacle connector, the electrical contacts of the respective connectors may exert forces with respect to each other. These forces can increase the magnitude of insertion force required to mate the connectors above desirable levels. For instance, when a header electrical connector having plug style electrical contacts is mated to a receptacle electrical connector having cantilevered beam electrical contacts, normal forces can be generated in the cantilevered beam contacts and applied against the corresponding plug contacts. These normal forces can result in an undesirably high level of insertion force being required to successfully mate the connectors.

SUMMARY

In accordance with an embodiment, an electrical contact includes an intermediate portion, a mating end extending from one end of the intermediate portion, and a mounting end extending from an opposed end of the intermediate portion. The mating end includes two beams cantilevered along their respective lengths with respect to the intermediate portion. The beams have respective lengths. The intermediate portion further includes a tie bar connected between the two beams. At least a portion of the beams along their respective lengths are separated from each other by an electrically dielectric material that is disposed on opposite sides of the tie bar.

In accordance with an alternative embodiment, an electrical contact body includes a mating end and an opposed mounting end, the mating end defining a pair of tips that are spaced apart with respect to each other. The contact body further includes an intermediate portion disposed between the mating and mounting ends. The intermediate portion has a proximal end configured to be disposed proximate to a front end of an electrical connector housing configured to carry the contact body. The contact body defines a slot extending there through that is disposed between the proximal end of the intermediate portion and the tips.

BRIEF DESCRIPTION OF THE DRAWINGS

The foregoing summary, as well as the following detailed description of the preferred embodiments of the application, will be better understood when read in conjunction with the appended drawings. For the purposes of illustrating the electrical connector with reduced normal force, there are shown in the drawings preferred embodiments. It should be understood, however, that the instant application is not limited to the precise arrangements and/or instrumentalities illustrated in the drawings, in which.

DETAILED DESCRIPTION

Figure 1A:
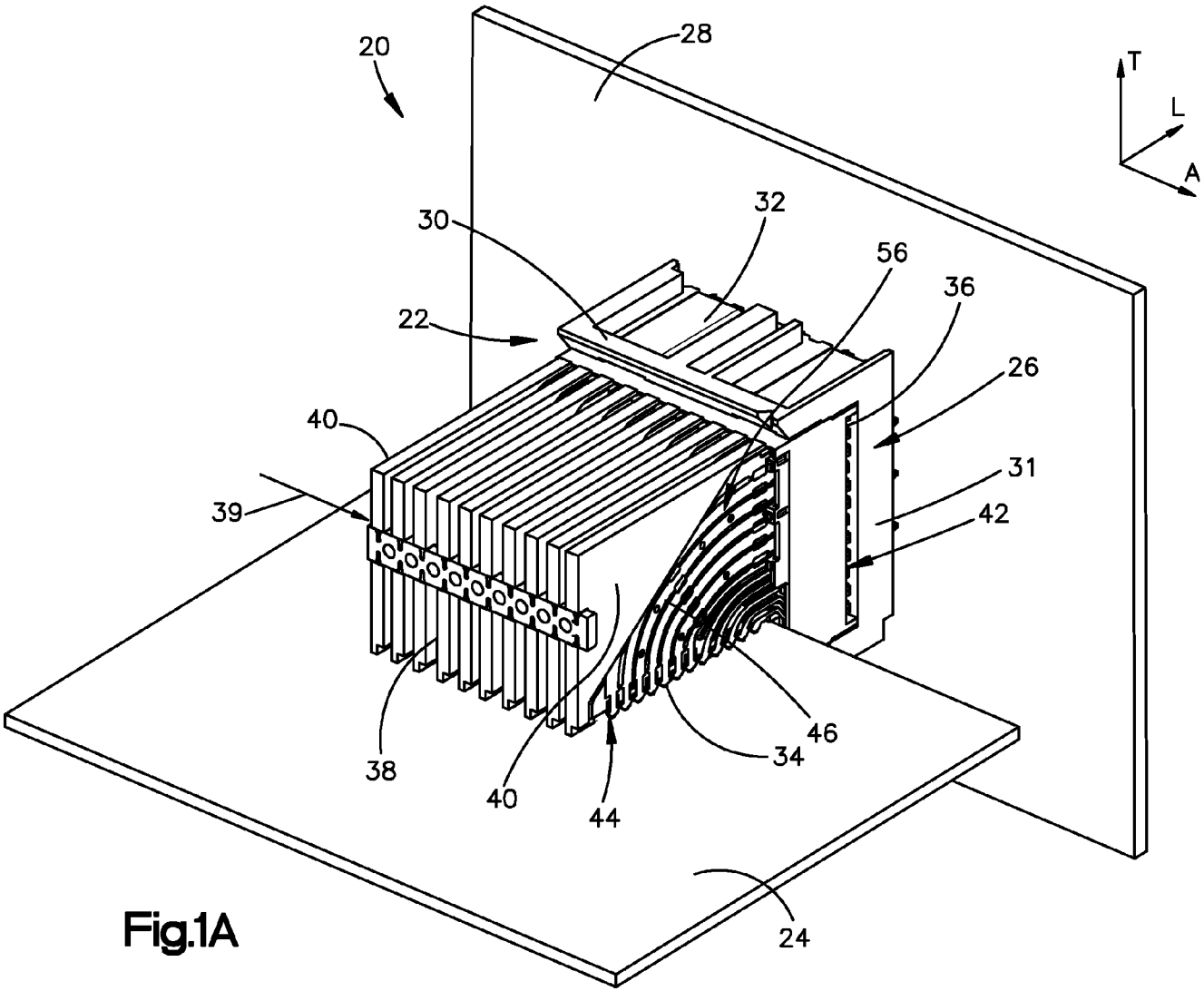
FIG. 1A is a perspective view of an electrical connector system including a first electrical connector and a second electrical connector that can each be mounted to respective printed circuit boards and mated so as to place the printed circuit boards in electrical communication with each other.

For convenience, the same or equivalent elements in the various embodiments illustrated in the drawings have been identified with the same reference numerals. Certain terminology is used in the following description for convenience only and is not limiting. The words "left", "right", "front", "rear", "upper," and "lower" designate directions in the drawings to which reference is made. The words "forward", "forwardly", "rearward", "inner," "inward," "inwardly," "outer," "outward," "outwardly," "upward," "upwardly," "downward," and "downwardly", refer to directions toward and away from, respectively, the geometric center of the object referred to and designated parts thereof. The terminology intended to be non-limiting includes the above-listed words, derivatives thereof and words of similar import.

Figure 1B:
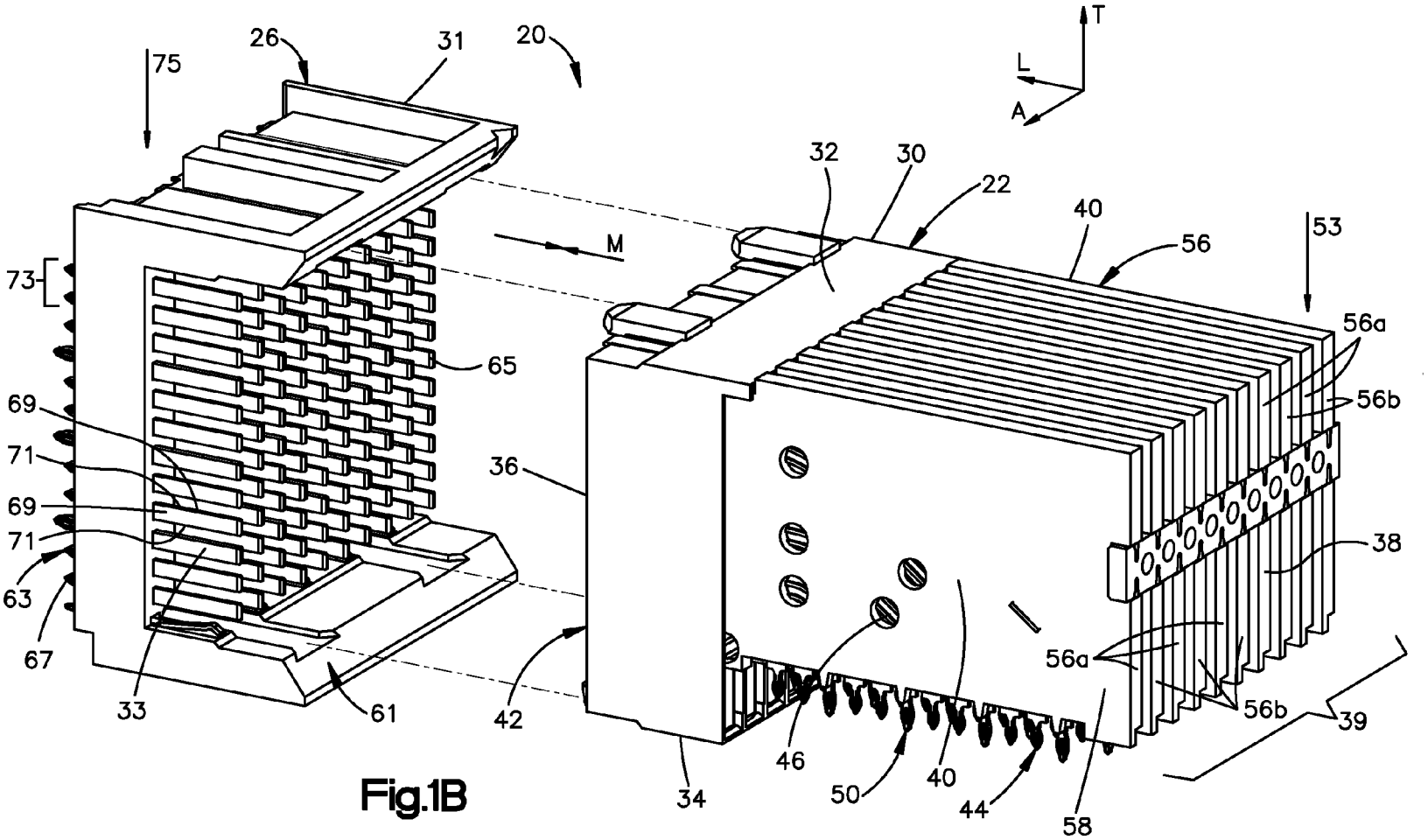
FIG. 1B is a perspective view of the first and second electrical connectors illustrated in FIG. 1A, aligned to be mated to each other.

Referring initially to FIGS. 1A-1B, an electrical connector system 20 constructed in accordance with one embodiment includes a number of components, such as a first electrical connector 22 configured to be electrically connected to a first substrate 24 which can be provided as a printed circuit board (PCB), and a complementary second electrical connector 26 configured to be electrically connected to a second substrate 28 such as a PCB. The complementary first and second electrical connectors 22 and 26 are configured to mate with each other so as to place the first and second substrates 24 and 28 in electrical communication with each other. For example, first electrical connector 22 may be plugged into the second electrical connector 26 or vice versa. The electrical connector system 20 can be constructed generally as described in U.S. Pat. No. 7,331,800, the disclosure of which is hereby incorporated by reference as if set forth in its entirety herein.

Continuing with FIGS. 1A-1B, the first electrical connector 22 includes a connector housing 30 that is dielectric or electrically insulative. The electrical connector defines a top end 32 and an opposed bottom end 34, a front end 36 and an opposed rear end 38, and opposed sides 40. The opposed front and rear ends 36 and 38 are spaced apart along a longitudinal direction L, the opposed sides 40 are spaced apart along a lateral direction A that is substantially perpendicular with respect to the longitudinal direction L, and the top and bottom ends 32 and 34 are spaced apart along a transverse direction T that is substantially perpendicular with respect to the lateral direction A and the longitudinal direction L. Unless otherwise indicated herein, the terms "lateral," "longitudinal," and "transverse" are used to describe the orthogonal directional components of various components. In accordance with the illustrated embodiment, the transverse direction T is oriented vertically, and the longitudinal and lateral directions L and A are oriented horizontally, though it should be appreciated that the orientation of the electrical connector 22 may vary during use.

In accordance with the illustrated embodiment, the first and second electrical connectors 22 and 26 are configured to be mated with each other along a mating direction M, which can extend substantially parallel to the longitudinal direction L. Thus, it can be appreciated that the first electrical connector 22 may define a mating interface 42 and a mounting interface. The mating interface 42 disposed proximate to the front end 36 and configured to mate with the second electrical connector 26 so as to establish an electrical connection between the first and second electrical connectors 22 and 26. The mounting interface 44 disposed proximate to the bottom end 34 and configured to be mounted onto first substrate 24 so as to establish an electrical connection between the first electrical connector 22 and the substrate 24. The second electrical connector 26 may also define a mating interface 61 configured to mate with the mating interface 42 of the first electrical connector 22 and a mounting interface 63 configured to operatively engage the second substrate 28. The mating interface 42 configured to mate with the first electrical connector 22 so as to establish an electrical connection between the first and second electrical connectors 22 and 26. The mounting interface 52 configured to be mounted onto second substrate 28 so as to establish an electrical connection between the second electrical connector 26 and the substrate 28. As shown, the first electrical connector 22 can be a right-angle electrical connector, whereby the mating interface 42 and the mounting interface 44 of the first electrical connector 22 are oriented substantially perpendicular to each other, though it should be appreciated that the first electrical connector 22 can alternatively be a vertical connector whereby the mating interface 42 and the mounting interface 44 are oriented substantially parallel to each other. Also as shown, the second electrical connector 26 can be a vertical electrical connector, whereby the mating interface 61 and the mounting interface 63 are oriented substantially parallel to each other, though it should be appreciated that the second electrical connector 26 can alternatively be a right-angle connector whereby the mating interface 61 and the mounting interface 63 are oriented substantially perpendicular to each other.

In accordance with the illustrated embodiment, the second electrical connector 26 includes a dielectric connector housing 31 that supports a plurality of electrical contacts 33, which can include signal contacts and ground contacts. The electrical contacts 33 may be insert molded prior to attachment to the connector housing 31, stitched into the connector housing 31, or otherwise supported by the connector housing 31. The electrical contacts 33 define respective mating ends 65 that extend along the mating interface 61, and mounting ends 67 that extend along the mounting interface 63. Each of the electrical contacts 33 can define respective first and second opposed broadsides 69 and first and second edges 71 connected between the broadsides 69. The edges 71 define a length less than that of the broadsides 69, such that the electrical contacts 33 define respective rectangular cross sections. The mounting ends 67 may be press-fit tails, surface mount tails, or fusible elements such as solder balls, which are configured to electrically connect to a complementary electrical component such as the second substrate 28, which can be configured as a backplane, midplane, daughtercard, or the like.

At least one or more pairs of adjacent electrical contacts 33 can be configured as differential signal pairs 73. In accordance with one embodiment, the differential signal pairs 73 are edge coupled, that is the edges 71 of each electrical contact 33 of a given differential signal pair 73 face each other along a common column 75 that extends in the transverse direction T. Thus, the second electrical connector 26 can include a plurality of differential signal pairs 73 arranged along respective column 75. The second electrical connector 26 can include any number of differential signal pairs 73 as desired that can be positioned edge-to-edge along the column 75.

Because the mating ends 65 of the electrical contacts 33 are configured as plugs that are configured to be received by the mating ends of the electrical contacts 46 of the complementary first electrical connector 22 when the first and second electrical connectors 22, 26, are mated, the second electrical connector 26 can be referred to as a plug or header connector. Alternatively, the second electrical connector 26 can be provided as a receptacle connector whereby the mating ends 65 are configured to receive plugs of a complementary electrical connector that is to be mated with the second electrical connector 26.

In accordance with the illustrated embodiment, the first electrical connector 22 may include a plurality of leadframe assemblies 56 that are supported by the dielectric connector housing 30. The leadframe assemblies 56 may be arranged as desired. For instance, the leadframe assemblies 56 may be spaced apart from one another along a row direction 39. The row direction 39 may be oriented parallel to lateral direction A.

The plurality of leadframe assemblies 56 can include a plurality of first leadframe assemblies **56*a* and a plurality of second leadframe assemblies 56*b* that are alternatingly arranged along the row direction 39. Thus, each of the first leadframe assemblies 56*a* can be disposed between a pair of second leadframe assemblies 56*b* or adjacent a second leadframe assembly 56*b*. Likewise, each of the second leadframe assemblies 56*b* can be disposed between a pair of first leadframe assemblies 56*a* or adjacent a first leadframe assembly 56*a*. Each of the plurality of first leadframe assemblies 56*a* can have a first electrical contact arrangement, and each of the plurality of second leadframe assemblies 56*b* can have a second electrical contact arrangement that differs from the first contact arrangement of each of the plurality of first leadframe assemblies 56*a*. Alternatively, the first and second leadframe assemblies 56*a* and 56*b*** can define the same arrangement of electrical contacts.

Figure 2B:
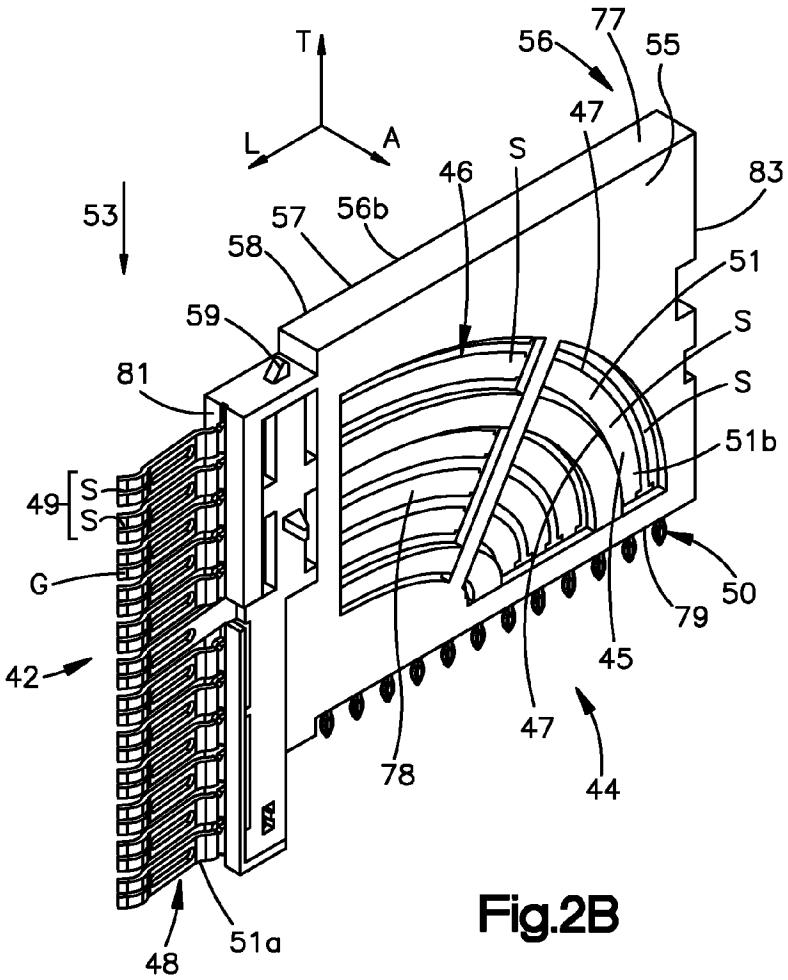
FIGS. 2A-2B are perspective views of a pair of leadframe assemblies of the first electrical connector illustrated in FIGS. 1A-1B.
Figure 2A:
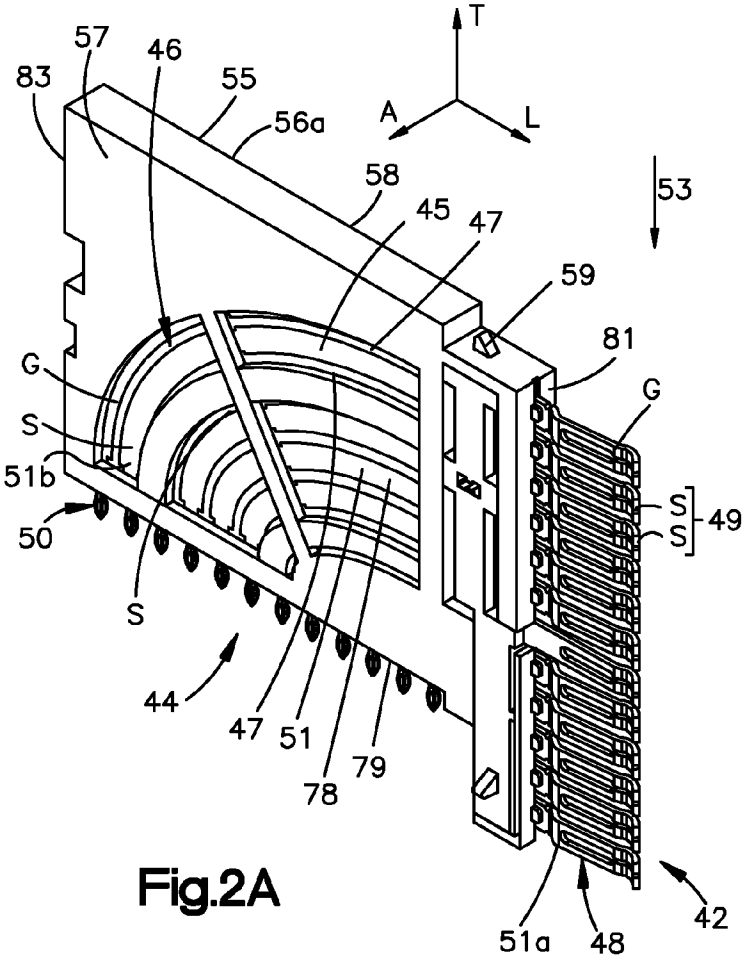
Figure 2C:
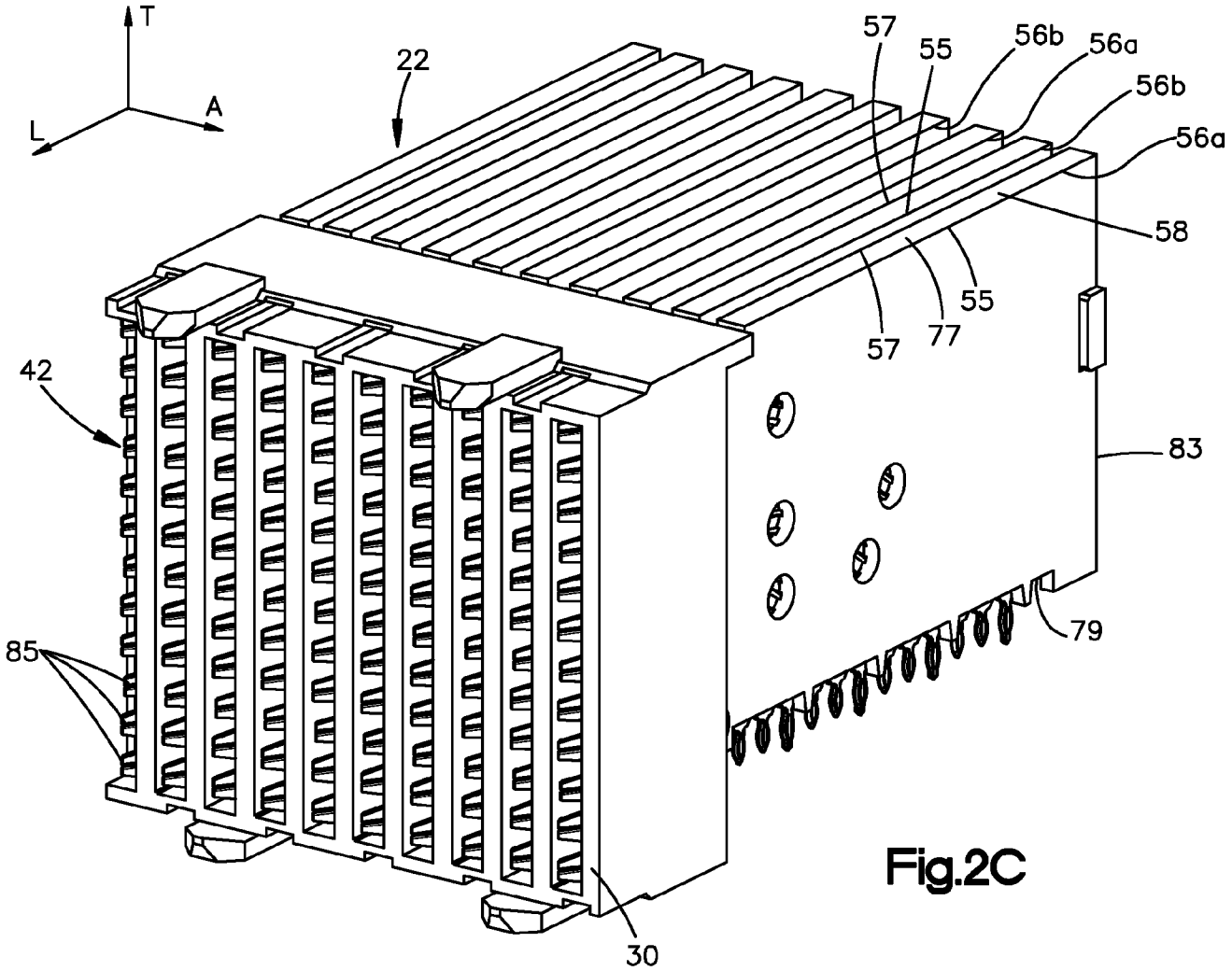
FIG. 2C is a perspective view of the first electrical connector comprising a plurality of leadframe assemblies as illustrated in FIGS. 2A-2B.
Figure 3A:
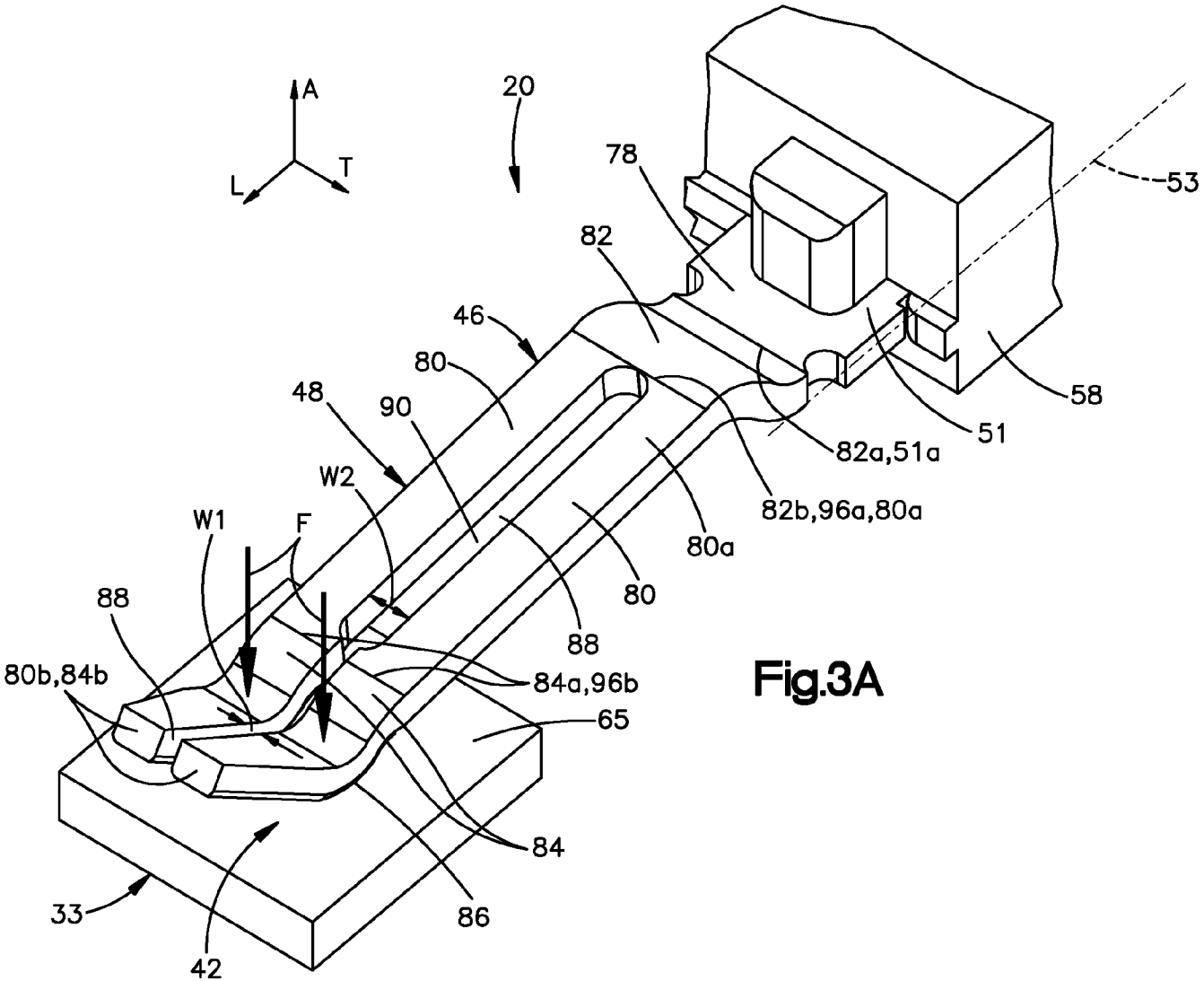
FIGS. 3A-3C illustrate a perspective view, a top view, and a side view, respectively, of an electrical contact carried by the leadframe assemblies illustrated in FIGS. 2A-2C, constructed in accordance with an embodiment.
Figure 3B:
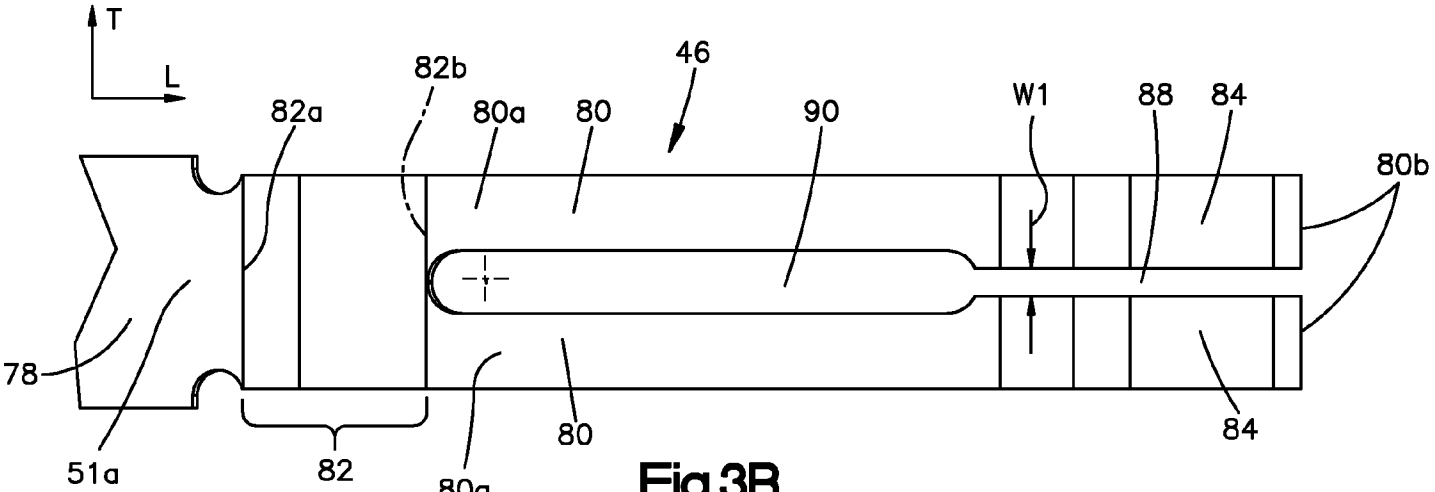
Figure 3C:
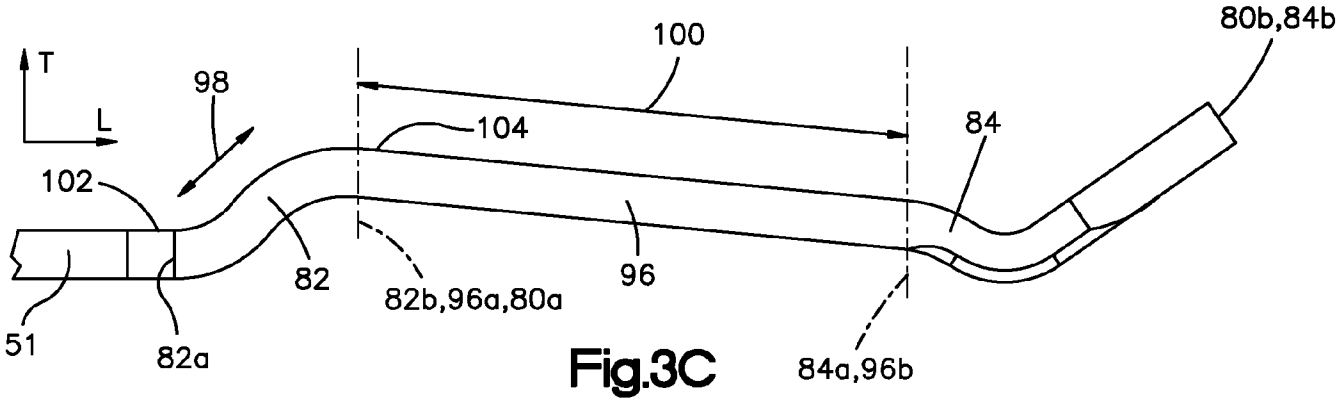

Referring now to FIGS. 2A-2C, each leadframe assembly 56 can include a leadframe housing 58 that comprise one or more dielectric or electrically insulative materials. The leadframe housing 58 of each leadframe assembly 56 defines laterally opposed first and second side surfaces or outer surfaces 55 and 57 that are spaced apart along the row direction 39 or lateral direction A. The leadframe housing 58 may also define a third or top outer surface 77 and fourth or bottom outer surface 79 spaced apart from one another along transverse direction T. The leadframe housing 58 may further define a fifth or front outer surface 81 and sixth or back outer surface 83 spaced apart from one another along longitudinal direction L. The lead frame housings 58 can be arranged in electrical connector 22 as desired. For example, as illustrated in FIG. 2C, two or more leadframe housings 58 can be arranged such that their respective first outer surface 55 face the second outer surface 57 of an adjacent leadframe housing 58.

In accordance with the illustrated embodiments, the electrical contacts 46 can be supported by respective leadframe assemblies 56 such that the mating ends 48 thereof are disposed longitudinally forward of the front end of the leadframe housing 58 along common transverse columns 53. As illustrated in FIG. 1C, two or more leadframe assemblies 56 may be arranged adjacent to one another in order to form rows 85 of electrical contacts 46 which extend in the row direction A.

In accordance with one embodiment, the leadframe assemblies 56 can be insert molded leadframe assemblies (IMLAs) whereby the respective electrical contacts 46 are overmolded by the corresponding leadframe housing 58. Alternatively, the electrical contacts 46 can be stitched or otherwise fixed in the respective leadframe housing 58. The leadframe housings 58 include engagement members illustrated as tabs 59 that are configured to engage respective engagement members of the connector housing 30 so as to secure the position of the respective leadframe housings 58 in the connector housing 30.

The electrical contacts 46 can include a plurality of signal contacts S and a plurality of ground contacts G. Any suitable dielectric material, such as air or plastic, may be used to isolate the electrical signal contacts 46 of one leadframe assembly 56 from those of an adjacent leadframe assembly 56. The electrical contacts 46 each define respective mating ends 48 that extend along the mating interface 42, and extend laterally forward from the leadframe housing 58 and are configured to mate with complementary mating ends 65 of the electrical contacts 33 of the second electrical connector 26. The electrical contacts 46 further define opposed mounting ends 50 that extend along the mounting interface 44. The mounting ends 50 may be press-fit tails, surface mount tails, or fusible elements such as solder balls, which are configured to electrically connect to a complementary electrical component such as the first substrate 24, which can be configured as a backplane, midplane, daughtercard, or the like. In the exemplary embodiment, each electrical contact 46 has one mounting end 50 along longitudinal direction L.

Each of the electrical contacts 46 can define respective first and second opposed broadsides 45 and first and second edges 47 connected between the broadsides. The edges 47 define a length less than that of the broadsides 45, such that the electrical contacts 46 define a rectangular cross section. Because the mating ends 48 of the electrical contacts 46 are configured as receptacles that receive mating ends of electrical contacts of the complementary second electrical connector 26, the first electrical connector 22 can be referred to as a receptacle connector (as illustrated in FIG. 1B), though it should be appreciated that the first electrical connector 22 can alternatively be configured as a plug or header connector whereby the mating ends 48 are configured as plugs that are received by the electrical contacts of the complementary second electrical connector 26 (as illustrated in FIG. 1A).

At least one or more pairs of adjacent electrical contacts 46 can be configured as differential signal pairs 49. In accordance with one embodiment, the differential signal pairs 49 are edge coupled, that is the edges 47 of each electrical contact 46 of a given differential signal pair 49 face each other along a transverse common column 53 that is substantially perpendicular to the row direction 39. Thus, the leadframe assemblies 56 can be spaced along a longitudinal row direction 39, and the electrical contacts 46 of each leadframe assembly 56 are spaced along respective columns 53, such that the electrical contacts 46 of adjacent leadframe assemblies 56 are arranged in spaced substantially parallel columns. Thus, the first electrical connector 22 can include a plurality of differential signal pairs 49 arranged along a given column 53. The first electrical connector 22 can include any number of signal pairs 49 positioned edge-to-edge along the respective columns 53, though the first electrical connector 22 can include any number of differential signal pairs along a given column as desired, such as two, three, four, five, six, or more differential signal pairs.

As described above, the electrical contacts 46 can include a plurality of signal contacts S and a plurality of ground contacts G. Signal S and ground G electrical contacts 46 can be arranged in a leadframe assembly 56 in order to form two different types of leadframe assemblies: first leadframe assembly 56*a* and second leadframe assembly 56*b* that may be alternately arranged along the row direction 39. Each first leadframe assemblies 56*a* can include an arrangement of the electrical contacts 46 in a repeating G-S-S pattern along a direction from the top of the respective leadframe housing 58 toward the bottom of the respective leadframe housing 58 at the mating interface 42. Each second leadframe assemblies 56*b* can include an arrangement of the electrical contacts 46 in a repeating S-S-G pattern along a direction from the top of the respective leadframe housing 58 toward the bottom of the respective leadframe housing 58 at the mating interface 42. Thus, the first and second leadframe assemblies 56*a-b* can define different patterns of signal and ground contacts. Alternatively, the first and second leadframe assemblies 56*a-b* can define the same pattern of signal contacts S and ground contacts G. Adjacent pairs of signal contacts S of each IMLA can define differential signal pairs 49, or the signal contacts S can alternatively be single ended. It should be further appreciated that the mating interface 42 can define an open pin field, such that the ground contacts G can alternatively be provided as signal contacts that can have a data transfer speed that is different (for instance less) than that of the signal contacts S. Thus, reference herein to contacts G is made for illustrative purposes only, it being appreciated that the contacts G can be provided as ground contacts as described above, or can alternatively be provided as signal contacts configured to transmit electrical signals during operation.

Referring now to FIGS. 2A-2C and 3A-3C, each of the electrical contacts 46 can include a contact body 78, the contact body 78 defines a mating end 48, a mounting end 50, and an intermediate portion 51 that extends between a proximal end 51*a* located substantially adjacent the mating end 48 of the body 78 and an opposed distal end 51*b* located substantially adjacent the mounting end 50 of the body 78. The intermediate portions 51 of the illustrated electrical contacts 46 are curved, but the contact bodies 78 are not limited to this geometry, and it should be appreciated that the intermediate portions 51 of the electrical contacts 46 can alternatively be constructed defining any other geometry as desired. The receptacle mating ends 48 of the contacts 46 can be configured to contact the header mating ends 65 of the electrical contacts 33 when the first and second electrical connectors 22 and 26 are mated along the mating direction M. More specifically, the mating ends 48 of the electrical contacts 46 can be constructed to engage the blade-type, or plug-type mating ends 65 of the electrical contacts 33.

The contact body 78 can define an inclined portion 82 that can be located between the mating and mounting ends 48 and 50, for instance at the proximal end 51*a* of the intermediate portion 51, proximate to the mating end 48. In accordance with the illustrated embodiment, the inclined portion 82 is located forward of the front end of the leadframe housing 58. For instance, the body 78 can be configured to be disposed within the leadframe housing 58 such that a proximal end 82*a* of the inclined portion 82 is disposed proximate to, for instance substantially at the front end of the leadframe housing 58, and rearward from the leading edge of the mating interface 42. That is, the proximal end 51*a* of the intermediate portion 51 can be configured to be disposed proximate to the front end of the connector housing 30.

In accordance with the illustrated embodiment, the mating ends 48 of at least one, such as all of the electrical contacts 46 can define a pair of cantilevered contact beams 80. The beams 80 can extend longitudinally forward between proximal ends 80*a* disposed at the distal end 82*b* of the inclined portion 82, and opposed distal ends 80*b*, such that the beams 80 are cantilevered along their respective lengths, as defined between the proximal and distal ends 80*a*, 80*b*, and cantilevered relative to the distal end 82*b* of the inclined portion 82. Individual beams 80 can define tips 84 and middle portions 96. Middle portion 96 may extend between proximal and distal ends 96*a*, 96*b* and tips 84 may extend between proximal and distal ends 84*a*, 84*b*. Proximal end 96*a* of middle portion 96 may be located adjacent to proximate end 80*a* of beam 80. Distal end 96*b* of middle portion 96 may be located adjacent to proximate end 84*a* of tips 84. Distal end 84*b* of tips 84 may be located adjacent to distal end 80*b* of beam 80. Tips 84 may be configured to make contact with the mating ends 65 of the electrical contacts 33 when the first and second electrical connectors 22 and 26 are mated to one another. The tips 84 can be constructed to define contact surfaces 86 along respective portions of the beams 80. For instance, each tip 84 of the illustrated embodiment defines a curved portion that extends longitudinally forward and laterally inward toward the column 53, then longitudinally further forward and laterally outward away from the column 53, defining a contact surface 86 along the lower surface of the tip 84, disposed substantially at the apex of the curvature.

At least a portion of the length of the inclined portion 82, as defined between the proximal and distal ends 82*a*, 82*b*, can be constructed so as to offset at least a portion of the mating end 48 of the body 78 with respect to its respective column 53. For example, the inclined portion 82 of the illustrated electrical contact 46 may defines a generally "S-shaped" curvature between the proximal and distal ends 82*a*, 82*b*. Of course the inclined portion 82 and/or any other portion of the body 78 can be differently constructed to offset the mating end 48 of the body 78 with respect to its respective column 53.

In accordance with the illustrated embodiment, the inclined portion 82 may extend relative to the intermediate portion 51 along a first slope 98 in the lateral direction A as the inclined portion extends from the intermediate portion 51 along the longitudinal direction L towards tips 84, the lateral direction A being substantially perpendicular to both the longitudinal direction L and the transverse direction T. For example, inclined portion 82 may extend between the proximal end 51*a* of the intermediate portion 51 and the proximal end 96*a* of the middle portion 96. Inclined portion 82 may result in outer surface 102, located adjacent to proximal end 51*a* of the intermediate portion 51 being lower than outer surface 104, located adjacent to proximal end 96*a* of the middle portion 96, along lateral direction A. Additionally, an entirety of inclined portion 82 may extend along first slope 98. Alternatively, substantially all of inclined portion 82 may extend along first slope 98. For example, inclined portion 82 may have an "S-shape" substantially all of which extends along the first slope 98.

The middle portion 96 may extend directly from the distal end 82*b* of the inclined portion 82 to the proximal end 84*a* of tip 84 along a constant second slope 100 in the lateral direction A as the middle portion extends away from the inclined portion 82 towards the tips 84. In an exemplary embodiment, constant second slope 100 may refer to any type of constant slope—such a constant linear slope or a constant non-linear slope. Additionally, all of middle portion 96 may extend along constant second slope 100. Alternatively, substantially all of middle portion 96 may extend along constant second slope 100. Further, first slope 98 may extend in a first lateral direction and constant second slope 100 may extend in a second lateral direction, where the second lateral direction may be different than the first lateral direction.

The beams 80 can be spaced apart along the transverse direction T, defining a gap 88 there between. The gap 88, extending along transverse direction T, between the illustrated beams 80 extends along substantially the entirety of the length of the beams 80 beams 80 extending along longitudinal direction L, that is from the proximal ends 80*a* through the distal ends 80*b*. It can therefore be said that the illustrated body 78 defines an electrical contact 46 having open distal ends 80*b* or tips 84, or split distal ends 80*b* or tips 84.

The transverse width of gap 88, as defined between the inner surfaces of the beams 80, can vary along one or more portions of the lengths of the beams 80. For example, the gap 88 between the illustrated beams 80 has a portion of width W2 that is greater than the width W1 of the remainder of the gap 88 located between tips 84. The widened portion of the gap 88, that is the portion having width W2, can define a U shaped slot 90 extending laterally through the mating end 48, the slot 90 elongate along the longitudinal direction L. The illustrated slot 90 is defined having a proximal end that is disposed at substantially the distal end 82*b* of the inclined portion 82 and a distal end disposed rearward of the tips 84, such that the slot 90 is disposed between the intermediate portion 51 of the body 78 and the tips 84 of the beams 80. The proximal and distal ends of the illustrated slot 90 are rounded. It should be appreciated that the electrical contacts 46 are not limited to the illustrated body 78. For instance, the contact beams 80 can alternatively be constructed so as to define a gap 88 and/or slot 90 having any other respective geometries as desired.

In operation, as the first electrical connector 22 is mated to the second electrical connector 26, the mating ends 65 of the contacts 33 of the second electrical connector 26 come into contact with the mating ends 48 of the electrical contacts 46 of the first electrical connector 22. More specifically, as the mating ends 65 come into contact with the mating ends 48, the lower surfaces of the tips 84 of the electrical contacts 46 ride along the leading edges of the mating ends 65. As the tips 84 longitudinally advance, riding along the leading edges of the mating ends 65, the contact beams 80 are deflected laterally outward, away from their respective columns 53, causing stresses opposing the deflection to build up in the mating ends 48, for example in the inclined portion 82 and/or in the beams 80. As the tips 84 advance further forward, such that the contacts surfaces 86 ride along the respective surfaces of the mating ends 65, forces F generated by the built up stresses are applied through the contact surfaces 86 onto the respective surfaces of the mating ends 65, along a direction substantially perpendicular to, or normal to, the respective surfaces of the mating ends 65.

Figure 4A:
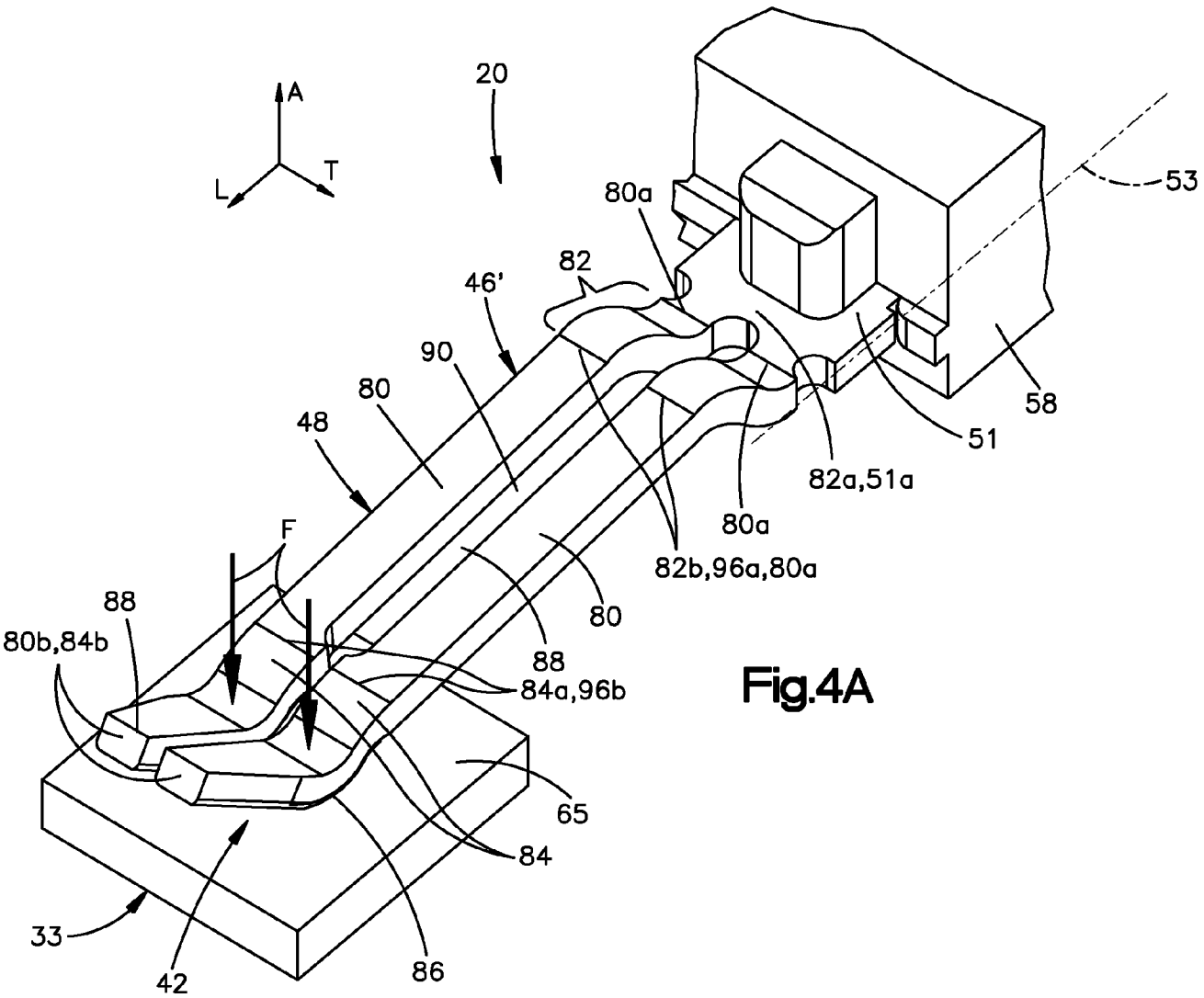
FIGS. 4A-4C illustrate a perspective view, a top view, and a side view of an electrical contact carried by the leadframe assemblies illustrated in FIGS. 2A-2C, constructed in accordance with an alternative embodiment.
Figure 4B:
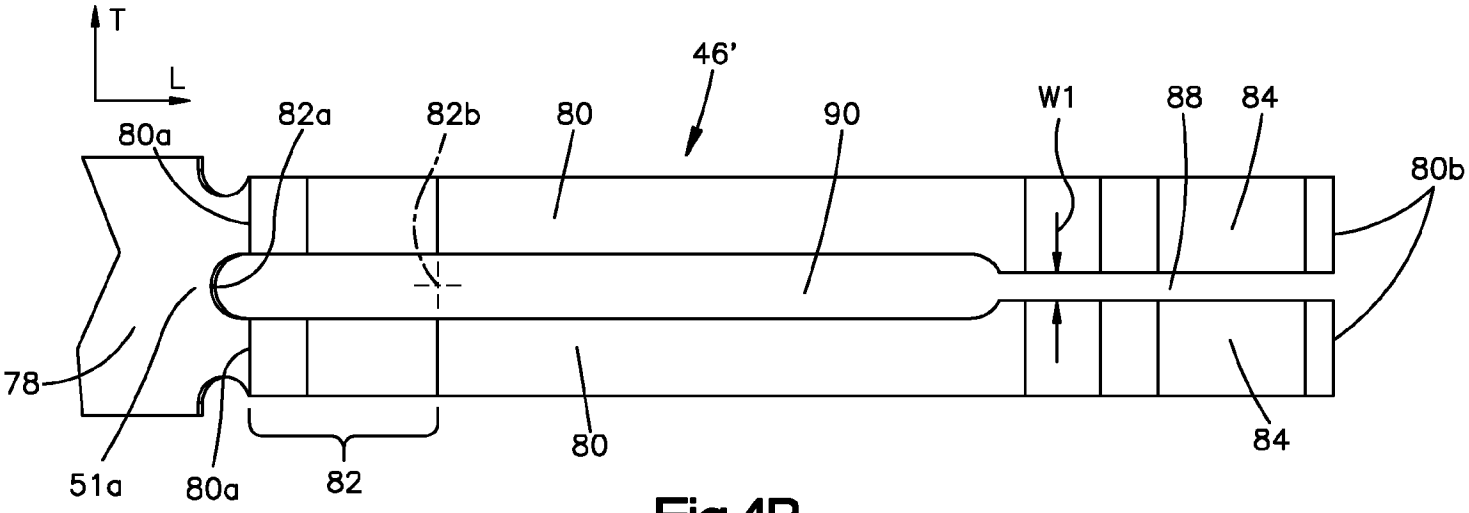
Figure 4C:
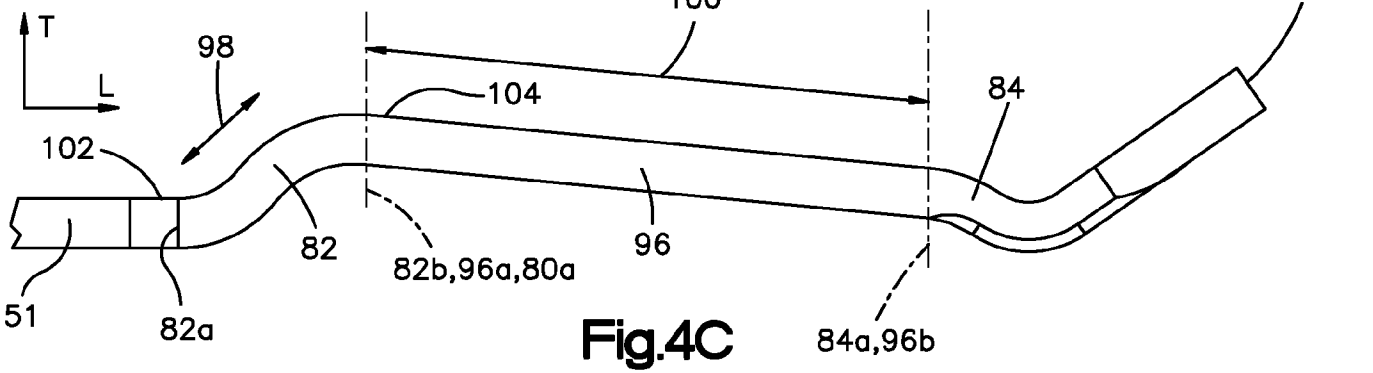

Referring now to FIGS. 4A-4C, an electrical connector system 20 is constructed in accordance with an alternative embodiment, including electrical contacts 46'. The electrical contact 46' is constructed substantially similarly to the electrical contact 46, but with a slot 90 that is longitudinally elongated with respect to that of the electrical contact 46, such that the slot 90 extends further rearward toward the front end of the leadframe housing 58. More specifically, the proximal end of the slot 90 is defined proximate to, for example substantially at the proximal end 82*a* of the inclined portion 82, and proximate to the proximal end 51*a* of the intermediate portion 51, such that the slot 90 extends into and at least partially through the inclined portion 82. Accordingly, the proximal ends 80*a* of the beams 80 are defined proximate to, for example substantially at the proximal end 82*a* of the inclined portion 82, such that the beams 80 are cantilevered with respect to the proximal end 82*a* of the inclined portion 82. Therefore, the beams 80 of the electrical contact 46' define longer respective lengths than those of the electrical contact 46.

When comparing operation of the electrical contact 46' with that of the electrical contact 46, the extended slot 90 of the electrical contact 46' can act to lower the level of stresses that build up in the mating ends 48 as the first and second electrical connectors 22 and 26 are mated, and thus reduce the normal force exerted by the electrical contacts 46' against the corresponding electrical contacts 33 relative to the normal force exerted by the electrical contacts 46 against the corresponding electrical contacts 33. It should be appreciated that the electrical contacts 46' are not limited to the illustrated body 78. For instance, the contact beams 80 can alternatively be constructed so as to define a gap 88 and/or slot 90 having any other respective geometries as desired.

Figure 5A:
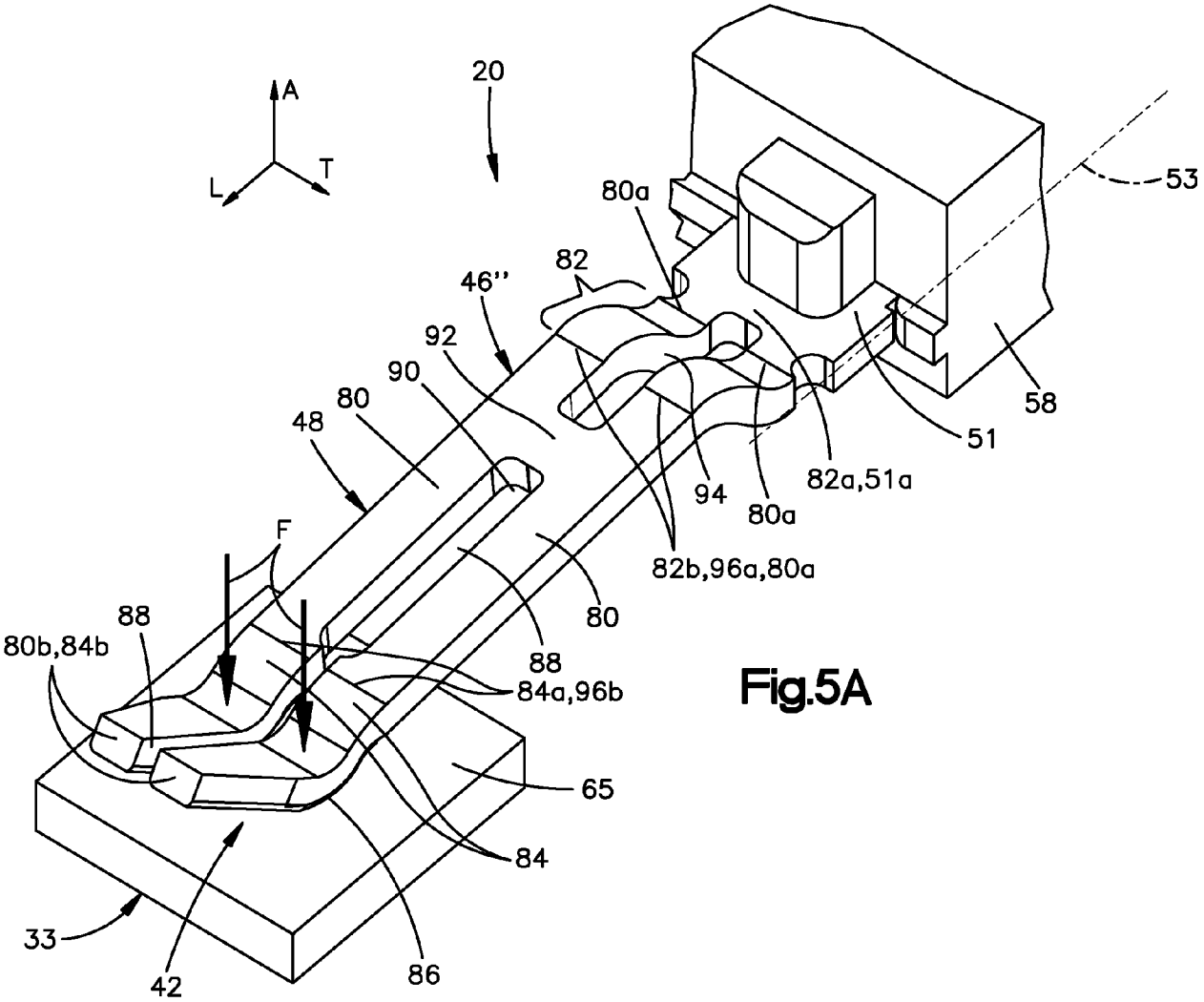
FIGS. 5A-5C illustrate a perspective view, a top view, and a side view of an electrical contact carried by the leadframe assemblies illustrated in FIGS. 2A-2C, constructed in accordance with yet another alternative an embodiment.
Figure 5B:
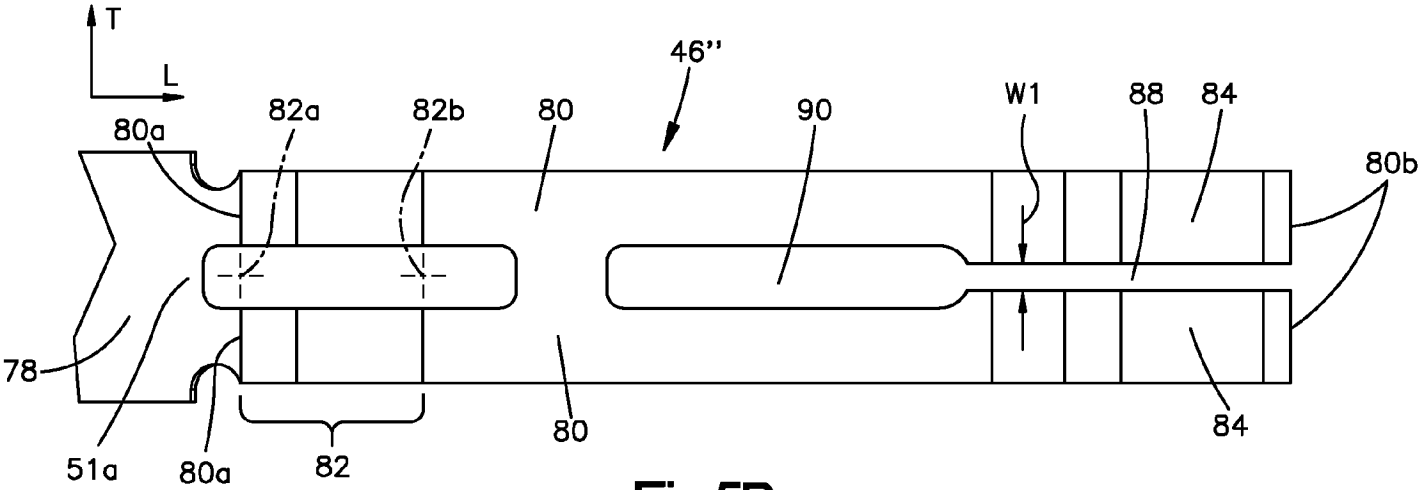
Figure 5C:
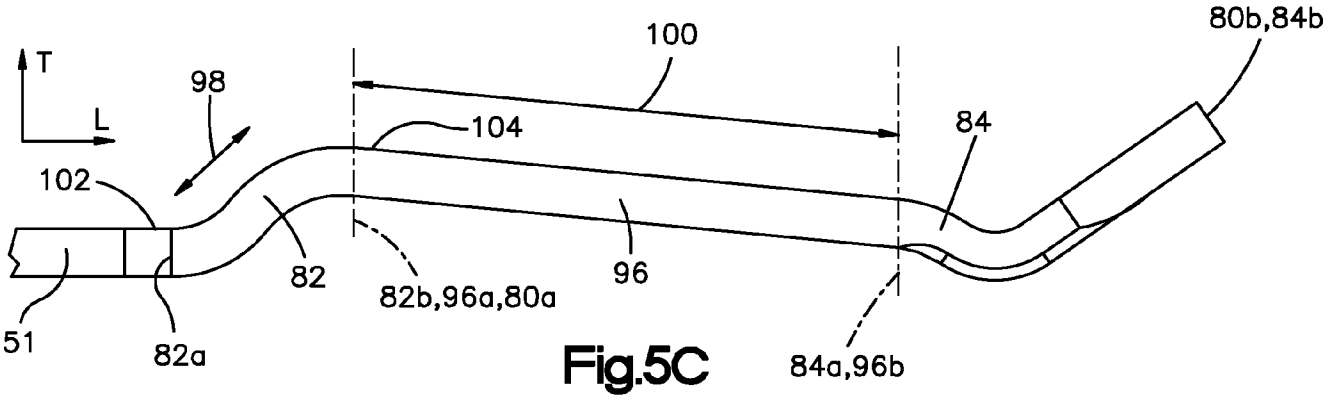

Referring now to FIGS. 5A-5C, an electrical connector system 20 is constructed in accordance with still another alternative embodiment, including electrical contacts 46". The electrical contact 46" is constructed substantially similar to the electrical contact 46', but further includes a tie bar 92 that extends transversely between the middle portions 96 of beams 80, coupling the beams 80 with respect to each other such that the mating ends 48 define gap 88, including slot 90, and a second gap, including slot 94. Slots 90, 94 may be longitudinally elongate slots located on opposing longitudinal sides of the tie bar 92, such that the tie bar 92 is disposed between the slots 90, 94. The illustrated tie bar 92 has a width which is approximately equal to that of the two beams 80 and is connected between the two beams 80, such that at least a portion of the beams 80, along their respective lengths, are separated from each other by an electrically dielectric material that is disposed on opposite sides of the tie bar 92. For instance, the illustrated tie bar 92 is connected between the beams 80 such that the beams 80 are separated from each other along their respective middle portions 96 by air. The tie bar 92 can be defined by the mating end 48, such that the tie bar 92 is integral with the beams 80. Alternatively, the tie bar 92 can be separately constructed, of the same or different material as that of the body 78, and affixed between the beams 80. In accordance with the illustrated embodiment, the tie bar 92 can be constructed of an electrically conductive material, such that the tie bar 92 electrically connects each of the pair of beams 80 to each other. It should be appreciated that the tie bar 92 can alternatively be constructed of any other material, such as an electrically dielectric material. Further, according to the exemplary embodiment, the tie bar 92 may extend along the second slope. Additionally, the tie bar 92 may be aligned with the middle portions 96 such that, for example, a top surface of the tie bar 92, along lateral direction A, may be flush with a top surface of the middle portions of the respective beams 80, along lateral direction A, of an electrical contact 46. Likewise, a bottom surface of the tie bar 92, along lateral direction A, may be flush with a bottom surface of the middle portions of the respective beams 80, along lateral direction A, of an electrical contact 46.

Further, the proximal end of the slot 94 can be defined nearer the proximal end 51*a* of the intermediate portion 51 than the proximal end of the slot 90 of the electrical contact 46', such that the slot 94 extends proximally further relative to the proximal end 82*a* of the inclined portion 82 than does the slot 90 of the electrical contact 46'. In other words, the slot 94 of the electrical contact 46" extends further rearward toward the front end of the leadframe housing 58 than does the slot 90 of the electrical contact 46'. Accordingly, the proximal ends 80*a* of the beams 80 are rearward or proximally of the proximal end 82*a* of the inclined portion 82, and substantially at the proximal end 51*a* of the intermediate portion 51, such that the beams 80 are cantilevered with respect to the proximal end 51*a* of the intermediate portion 51. Therefore, the beams 80 of the electrical contact 46" define longer respective lengths than those of the electrical contact 46'. Furthermore, the electrical contact 46" defines a slot geometry, for example as defined between the distal end of the slot 90 and the proximal end of the slot 94 of the electrical contact 46", that is longer than that of the electrical contact 46', as defined between the distal and proximal ends of the slot 90 of the electrical contact 46'.

The slots 90, 94 can be sized the same or differently, for example in accordance with the longitudinal location along the respective lengths of the beams 80 at which the tie bar 92 is disposed, the respective transverse widths of the slots 90, 94, and so on. The illustrated tie bar 92 is disposed proximate to and forward of the distal end 82*b* of the inclined portion 82, defining a first, or forward slot 90 that is longitudinally longer than the second, or rear slot 94. In the illustrated embodiments, slot 94 is ovular, longitudinally elongate shaped. It should be appreciated that the electrical contact 46" is not limited to the illustrated location of the tie bar 92, and that the electrical contact 46" can alternatively be constructed with the tie bar 92 located at any other location along the respective lengths of the beams 80 as desired. It should further be appreciated that the electrical contact 46" is not limited to a single tie bar, and that the electrical contact 46" can alternatively be constructed with a plurality of tie bars 92, sized the same or differently, as desired, and disposed at any desired locations along the respective lengths of the beams 80.

The tie bar 92 can cause at least portions of the respective bodies 78 of the electrical contacts 46", such as the beams 80, to exhibit greater structural rigidity with respect to each other than those of the electrical contact 46'. For instance, the tie bar 92 can aid in maintaining the width W1 of the gap 88 between the beams 80, for instance the width between the tips 84, during mating of the first and second electrical connectors 22 and 26.

When comparing operation of the electrical contact 46" with that of the electrical contacts 46' the slots 90, 94 of the electrical contact 46", in concert with the increased length of the beams 80 can act to lower the level of stresses that build up in the body 78 as the first and second electrical connectors 22 and 26 are mated, and thus reduce the normal force exerted by the electrical contacts 46" against the corresponding electrical contacts 33 relative to the normal force exerted by the electrical contacts 46 and 46' against the corresponding electrical contacts 33. It should be appreciated that the electrical contacts 46" are not limited to the illustrated body 78. For instance, the contact beams 80 can alternatively be constructed so as to define a gap 88 and/or slots 90, 94 having any other respective geometries as desired.

It should be appreciated that the first electrical connector 22 need not be constructed having electrical contacts belonging to only a single one of the above-described electrical contacts 46, 46', or 46". For example, the first electrical connector 22 can alternatively be constructed with any combination of electrical contacts 46, 46', and/or 46" as desired.

Although the electrical connector with reduced normal force has been described herein with reference to preferred embodiments and/or preferred methods, it should be understood that the words which have been used herein are words of description and illustration, rather than words of limitation, and that the scope of the instant disclosure is not intended to be limited to those particulars, but rather is meant to extend to all structures, methods, and/or uses of the herein described electrical connector with reduced normal force. Those skilled in the relevant art, having the benefit of the teachings of this specification, may effect numerous modifications to the electrical connector with reduced normal force as described herein, and changes may be made without departing from the scope and spirit of the instant disclosure, for instance as recited in the appended claims.

What is claimed:

1. An electrical contact configured to be supported by a leadframe housing, the electrical contact comprising:

an intermediate portion, a mating end extending from one end of the intermediate portion, the mating end configured to be disposed forward of a front end of the leadframe housing when the intermediate portion is disposed in the leadframe housing, and a mounting end extending from an opposed end of the intermediate portion, the mating end comprising two beams cantilevered along their respective lengths, the mating end further including a tie bar connected between the two beams, wherein at least a portion of the beams along their respective lengths are separated from each other by an electrically dielectric material that is disposed on opposite sides of the tie bar.

2. The electrical contact of claim 1, wherein the tie bar is electrically conductive and electrically connects each of the pair of beams to each other.

3. The electrical contact of claim 1, wherein the tie bar is located forward of a base section of the electrical contact.

4. The electrical contact of claim 1, wherein the tie bar is disposed between a pair of longitudinally elongate gaps defined by the cantilevered beams.

5. The electrical contact of claim 1, wherein the mounting end is configured to electrically connect to a complementary electrical component at a single location.

6. An electrical contact body comprising:

a mating end and an opposed mounting end, the mating end defining a pair of tips that are spaced apart with respect to each other; and an intermediate portion disposed between the mating and mounting ends, the intermediate portion having a proximal end configured to be disposed proximate to a front end of a leadframe housing configured to carry the contact body, the contact body defining a gap extending there through, the gap disposed between the proximal end of the intermediate portion and the tips, wherein the contact body further defines an inclined portion that extends from the proximal end of the intermediate portion toward the tips and the gap extends into the inclined portion.

7. The electrical contact of claim 6, wherein the mounting end is configured to electrically connect to a complementary electrical component at a single location.

8. The electrical contact of claim 6, wherein the contact body comprises a middle portion between the proximal end of the intermediate portion and the tips, and a first width of the gap between the middle portion is greater than a second width of the gap between the tips.

9. A leadframe assembly comprising:

a plurality of electrical contacts, each of the plurality of electrical contacts defining an intermediate portion, a mating end at a proximal end of the intermediate portion, and a mounting end at an opposed distal end of the intermediate portion, the mating end of each electrical contact defining a pair of cantilevered beams spaced apart from each other to define a gap; and a leadframe housing configured to support the plurality of electrical contacts, wherein when the plurality of electrical contacts are supported in the leadframe housing, the respective proximal end of each of the plurality of electrical contacts is disposed forward of a front end of the leadframe housing, wherein the mating end of each electrical contact further defines a tie bar connected between the cantilevered beams.

10. An electrical contact configured to be supported by a leadframe housing, the electrical contact comprising:

an intermediate portion, a mating end extending from one end of the intermediate portion, a mounting end extending from a second opposed end of the intermediate portion, the mating end comprising two cantilevered beams that are elongate along a longitudinal direction and spaced apart from each other along a transverse direction that is substantially perpendicular to the longitudinal direction so as to define a gap disposed between the cantilevered beams along the transverse direction, each of respective beams defining a tip and a middle portion, the tip defining a contact region, wherein the electrical contact further defines an inclined portion that extends from the intermediate portion, the inclined portion extending relative to the intermediate portion along a first slope in a lateral direction as the inclined portion extends from the intermediate portion along the longitudinal direction, the lateral direction substantially perpendicular to both the longitudinal direction and the transverse direction, and the middle portion extends directly from the inclined portion to the tip along a constant second slope in the lateral direction, wherein the second slope is different than the first slope, wherein the gap extends into the inclined portion.

11. The leadframe assembly of claim 9, wherein the cantilevered beams and the tie bar define a first gap and a second gap extending there through.

12. The leadframe assembly of claim 11, wherein the first and second gaps are defined between the cantilevered beams, on opposed sides of the tie bar.

13. The leadframe assembly of claim 12, wherein the cantilevered beams further define a pair of tips disposed at respective proximal ends of the cantilevered beams.

14. An electrical contact configured to be supported by a leadframe housing, the electrical contact comprising:

an intermediate portion, a mating end extending from one end of the intermediate portion, a mounting end extending from a second opposed end of the intermediate portion, the mating end comprising two cantilevered beams that are elongate along a longitudinal direction and spaced apart from each other along a transverse direction that is substantially perpendicular to the longitudinal direction so as to define a gap disposed between the cantilevered beams along the transverse direction, each of respective beams defining a tip and a middle portion, the tip defining a contact region, wherein the electrical contact further defines an inclined portion that extends from the intermediate portion, the inclined portion extending relative to the intermediate portion along a first slope in a lateral direction as the inclined portion extends from the intermediate portion along the longitudinal direction, the lateral direction substantially perpendicular to both the longitudinal direction and the transverse direction, and the middle portion extends directly from the inclined portion to the tip along a constant second slope in the lateral direction, wherein the second slope is different than the first slope, wherein the mating end further comprises a tie bar connected between the middle portion of the respective beams, the tie bar extending along the constant second slope.

15. The electrical contact of claim 14, wherein the first slope is in a first lateral direction and the second slope is in a second lateral direction that is opposite the first direction.

16. The electrical contact of claim 14, further comprising:

the leadframe housing configured to support the electrical contact, wherein when the electrical contact is supported in the leadframe housing, the mating end of the electrical contact is disposed forward of a front end of the leadframe housing.

17. The electrical contact of claim 10, wherein the first slope is in a first lateral direction and the second slope is in a second lateral direction that is opposite the first direction.

18. The electrical contact of claim 10, further comprising:

the leadframe housing configured to support the electrical contact, wherein when the electrical contact is supported in the leadframe housing, the mating end of the electrical contact is disposed forward of a front end of the leadframe housing.

19. The electrical contact of claim 14, wherein a width of the gap between the middle portion of the respective beams is greater than a second width of the gap between the tips of the respective beams.

20. The electrical contact of claim 14, wherein the gap extends into the inclined portion.

21. The electrical contact of claim 10, wherein a width of the gap between the middle portion of the respective beams is greater than a second width of the gap between the tips of the respective beams.

* * * * *